US005227587A

United States Patent [19]

Paterek

[11] Patent Number: 5,227,587

[45] Date of Patent: Jul. 13, 1993

[54] HERMETIC ASSEMBLY ARRANGEMENT FOR A CURRENT CONDUCTING PIN PASSING THROUGH A HOUSING WALL

[75] Inventor: F. Dieter Paterek, Cincinnati, Ohio

[73] Assignee: Emerson Electric Co., St. Louis, Mo.

[21] Appl. No.: 698,954

[22] Filed: May 13, 1991

[51] Int. Cl.[5] ..... H01B 17/26

[52] U.S. Cl. ..... 174/152 GM; 174/151; 174/152 R; 174/153 R; 174/50.61; 174/65 R

[58] Field of Search ..... 174/152 R, 151, 152 GM, 174/153 R, 152 E, 152 S, 65 SS, 65 G, 65 R, 50.61; 439/736, 935

[56] References Cited

U.S. PATENT DOCUMENTS

| | | | |
|---|---|---|---|
| 1,731,597 | 10/1929 | Spear | 174/11 BH X |
| 2,654,070 | 9/1953 | Lamb | 174/50.56 X |
| 2,768,231 | 10/1956 | Schwennesen et al. | 174/18 |
| 3,158,682 | 11/1964 | Goellner | 174/151 |
| 3,165,715 | 1/1965 | Leiss et al. | 174/18 X |
| 3,721,943 | 3/1973 | Curr | 439/935 X |
| 4,362,792 | 12/1982 | Bowsky et al. | 174/50.61 X |

OTHER PUBLICATIONS

IBM Technical Disclosure Bulletin, Knight, Vacuum Feed-Through Bushing, Dec. 4, 1959, vol. 2, No. 4 p. 9.

*Primary Examiner*—Leo P. Picard
*Assistant Examiner*—Hyung S. Sough
*Attorney, Agent, or Firm*—Polster, Lieder, Woodruff & Lucchesi

[57] ABSTRACT

A hermetic terminal assembly arrangement for an opening extending through a wall housing panel wherein the opening periphery is threaded to adjustably receive an externally threaded annular sleeve through which a current conducting pin extends, the terminal assembly arrangement including a first seal between the pin and annular sleeve and a second compressible seal between the sleeve and housing.

9 Claims, 2 Drawing Sheets

HERMETIC ASSEMBLY ARRANGEMENT FOR A CURRENT CONDUCTING PIN PASSING THROUGH A HOUSING WALL

BACKGROUND OF THE INVENTION

The present invention relates to hermetic assemblies and more particularly to a hermetic assembly arrangement which can be associated with electrical connection openings of a walled housing for large motor units.

It is well known in the art to provide a terminal assembly which incorporates a current carrying electrically connected terminal pin which extends in sealed relation through a cup-shaped body. The cup-shaped body, in turn, is fixedly mounted in sealed relation in a housing wall opening, the outer segment of the pin being connected to an electrical power source and the inner segment of the pin being hermetically confined in the housing and conductively connected to an appropriate hermetically sealed motor unit in the housing. Such a hermetic terminal assembly arrangement can be found in a number of U.S. patents issued to Benjamin Bowsky et al, including U.S. Pat. No. 4,584,433, issued on Apr. 22, 1966, the general arrangement being particularly adapted to hermetically sealed housings for comparatively low horse-power rated compressor units (for example, one horse-power) and, as above noted, each of the terminal assemblies is permanently fixed in sealed position with respect to the housing with which it is associated.

In those instances where compressor units have been much larger and have had a comparatively much higher horse-power rating (for example, ninety horse power) it also is known to provide current electrically connected terminal pins each of which can be threaded adjacent at least at one extremity and bolt head configured at the other or threaded adjacent both extremities to extend through opposed faces of an annular compressible seal usually of rubber. The compressible annular seal is sized to snugly engage in an opening in the wall of the housing for the compressor with the outer surrounding peripheral surface of the seal abutting the inner periphery of the wall opening and the inner periphery abutting the peripheral surface of the conducting pin. A threaded nut, or a pair of nuts, depending on the nature of the threaded type of pin utilized, engages with the pin threads to longitudinally urge separate annular insulated members against opposed faces of the annular compressible seal to radially expand the same, thus providing tightened sealing engagement between the pin and housing wall opening. Such past arrangements conventionally have required fabricated insulation panels on opposite sides of the wall through which the pin extremities pass to further insulate the pins, the panel requiring a removal of all tightening nuts to gain full access to one pin.

It has been recognized that this past adjustable arrangement not only is comparatively expensive in manufacture and assembly, but that the compressible expansible seal leads to sealing problems due to thermal changes and compressible material distortions which might occur. In addition, it has been recognized that problems of accessibility and effective sealing during assembly can occur since uniform pressure along both faces of the compressible seal is required to provide uniform radial expansion of the compressible seal for effective sealing along both the peripheral wall of the opening and the peripheral surface of the pin.

In accordance with the present invention, a unique terminal assembly arrangement resolves these recognized problems, providing a self-contained pin assembly which utilizes a minimum of parts, which can be economically and readily manufactured and which can be assembled for quick installation and removal in the wall openings of a housing for hermetic sealing therewith, without requiring fabricated insulation panels and the concomitant requirement of a removal of all associated tightening nuts to gain access to one pin. In addition, each of the unique and novel terminal assembly arrangement can be inserted as a complete unit including glass to metal seals within the opening of a housing in a minimum of time and with a minimum of steps to provide a positive, uniform hermetic seal with the wall housing panel that is operational over long periods of time for broad thermal ranges.

Various other features of the present invention will become obvious to one skilled in the art upon reading the disclosure set forth herein.

BRIEF SUMMARY OF THE INVENTION

More particularly the present invention provides a hermetic terminal assembly arrangement for a pin opening means extending through and between opposed faces of a portion of a wall of a machine housing comprising: internal thread means surroundingly extending along the inner peripheral surface of the pin opening means between opposed faces of the portion of the wall; externally threaded annular sleeve means, adjustably engaging with the internal thread means of the pin opening means the annular sleeve means including an inner peripheral wall; current conducting pin means extending longitudinally through the inner peripheral wall of the externally threaded annular sleeve means in spaced relation to the inner peripheral wall of the annular sleeve means when the annular sleeve means is engaged with the internal thread means of the pin opening means; a first sealing means cooperatively disposed between the current conducting pin means and the externally threaded sleeve means; and a second sealing means including a compressible seal disposed between the externally threaded sleeve means and the pin opening means in the portion of the wall to provide a tightly compressed seal therebetween when the externally threaded sleeve means is in full threaded engagement with the internally threaded pin opening means so that the first and second sealing means tightly seal the pin opening means in the portion of the wall.

It is to be understood that various changes can be made by one skilled in the art in one or more of the several parts of the structure disclosed herein without departing from the scope or spirit of the present invention.

BRIEF DESCRIPTION OF THE DRAWINGS

Referring to the drawings which disclose one advantageous embodiment of the present invention, along with a modification thereof.

DETAILED DESCRIPTION OF THE DRAWINGS

Figure 1:
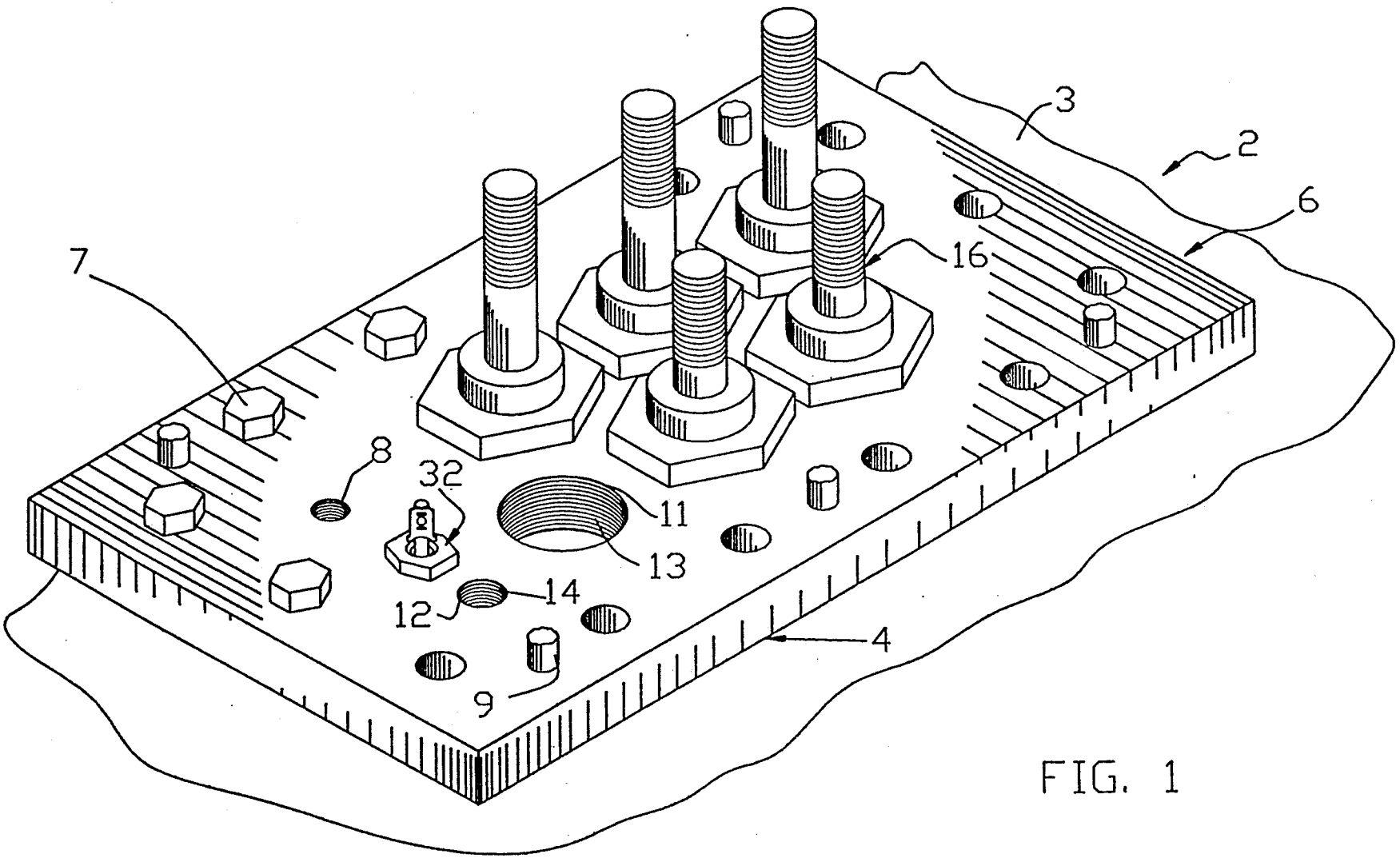
FIG. 1 is an enlarged isometric view of a wall housing panel incorporating the novel self-contained hermetic terminal assembly arrangement of the present invention, a battery o the larger terminal assemblies being shown in accompaniment with smaller control unit current conducting pin assemblies for lower rated current demands (only one of which is shown), all of which incorporate some of the features of the present invention.
Figure 2:
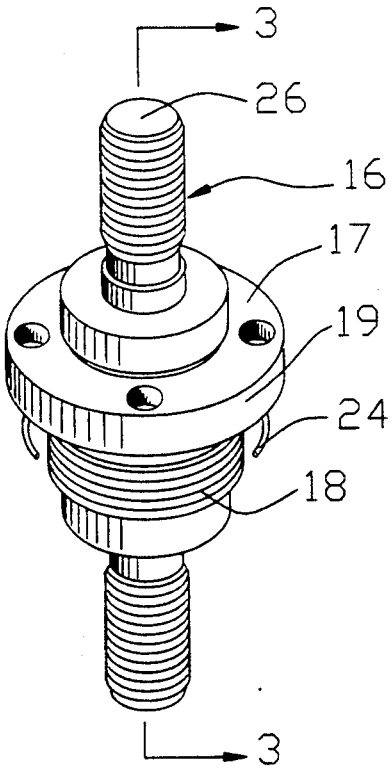
FIG. 2 is an isometric view of one of the novel larger self-contained hermetic terminal assemblies disclosed in FIG. 1 of the drawings.
Figure 3:
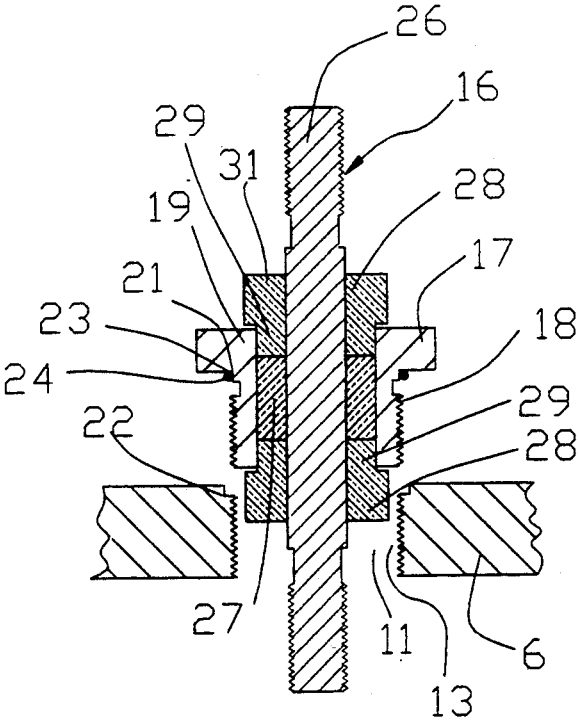
FIG. 3 is a cross-sectional partially exploded view of the larger terminal pin assembly of FIG. 2 taken in a plane through line 3—3 of FIG. 2, further disclosing a portion of the wall housing panel and the sealing member between the assembly and panel.

Referring to FIG. 1-3 of the drawings, the novel hermetic terminal panel assembly 2 is disclosed for mounting in wall 3 of a hermetically sealed machine housing. Such a sealed housing can incorporate a comparatively large size compressor with a rating as high as three hundred (300) horsepower which conventionally demands high operating voltages and currents. A suitable control unit including current carrying means associated with the large compressor also is included in the sealed housing. The control unit conventionally demands lower current and voltage ratings. Accordingly, provisions are usually made for bringing the differing power requirements to both the compressor and the control unit (neither shown). Hermetic terminal assembly 2 serves to accomplish this in a unique fashion in association with wall 3. It is to be understood that the several features of the present invention, although particularly suitable for sealed housings for larger type compressor and control units, are not to be considered as limited to the particular size and shape disclosed and, that such features can also be utilized with smaller compressors, such as those with a rating as low or even lower than only one horse power.

In accordance with one unique feature of the present invention, wall 3 of the hermetically sealed machine can be provided with an appropriately sized opening therethrough to receive separate unitary wall panel 6 removably mounted in gasket sealed relation on wall 3 by suitable fastening members 7 extending in spaced relation adjacent the perimeter of panel 6. Panel 6 can be provided with selectively spaced threaded openings 8 which serve to receive a plurality of support rods 9 for a panel cover (not shown). The panel 6 can be formed from an appropriate stainless steel or from the same material as wall 3 of the housing and, in this regard, it is to be understood that a number of the features of the present invention could be incorporated directly into wall 3 of the sealed housing with the panel 6 as a separate unit being eliminated. The separate unitary wall panel 6 is sized and configured to fully cover panel opening 4. Panel 6 in the disclosed advantageous embodiment of the present invention is provided with a total of six (6) larger spaced openings 11 (only one of which can be seen) arranged in two staggered rows of three and two (2) smaller spaced openings 12 (only one of which can be seen) arranged in a row extending normal to the two rows of larger openings. These larger openings and smaller openings 12 (longitudinally) extend between opposed faces of panel 6, each opening being provided with internal threads as at 13 and 14, respectively, the threaded openings each serving to receive one appropriately sized and rated self-contained, appropriately threaded conducting pin assembly described hereinafter.

Referring particularly to FIGS. 2 and 3 of the drawings, a self-contained inventive larger assembly 16, capable of being quickly inserted into one of the larger openings 11 to electrically conduct higher power requirements to a larger compressor unit is disclosed. This self-contained assembly 16 includes an annular sleeve 17 which is externally threaded as at 18 with threads adapted to engage in male-female relation with threads 13 of a larger opening 11. Externally threaded annular sleeve 17 can be tooled or cast from any one of a number of suitable materials and, advantageously, can be formed from a suitable stainless steel or ceramic material. Each annular sleeve 17 is of a length substantially equivalent to the length of opening 11 so that external threads 18 can adjustably engage with internal threads 13 of such opening, which threads 13 extend longitudinally from one panel face to the other. Each sleeve 17 can include an annular shoulder 19. As can be seen in FIG. 3, and annular under corner 21 is provided by each shoulder 19 where it meets the threaded body of sleeve 17, this under corner 21 being adapted to the diametrically opposed to an annular groove or set-off 22 adjacent to and surrounding large opening 11 on the outer face of unitary wall panel 6. With this configuration of diametrically opposed corner 21 and groove 22 a closeable annular recess 23 is provided therebetween when annular sleeve 17 is fully engaged in an opening 11. As can be seen in the drawings each closeable recess is provided with an appropriately sized compressible O-ring 24 size and disposed in a correspondingly, but smaller sized closeable annular recess 23 and being of suitable cross-sectional thickness to be compressed by the force exerted diametrically across the O-ring when annular under corner 21 is moved toward opposed annular groove 22 so as to tightly seal the space therebetween.

As also can be seen in the drawings, particularly FIGS. 2 and 3, each annular sleeve 17 serves to receive a current conducting pin 26. Each pin 26 can be formed from any one of a number of suitable, electrically conductive materials and advantageously can be of a suitable nickel steel with or without a copper core, being of sufficient cross-sectional diameter to be in accordance with rated power demands. Pin 26 is positioned to extend longitudinally along the central longitudinal axis of annular sleeve 17 with its outer peripheral surface in spaced relation from the inner peripheral surface of the externally threaded annular sleeve 17 with which it is associated. The pin 26 is of sufficient length that the segment on the outer face of panel 6 can be connected to an appropriate power source (not shown) and the segment on the inner face of panel 6 can be connected to the machine to be served.

Extending between the outer peripheral surface of each pin 26 and the internal peripheral surface of threaded annular sleeve 17 is a hermetic seal 27, which advantageously can be of a suitable glass material known in the art and which can be fused to the opposed outer pin and inner sleeve surfaces. To further insulate each pin 26 from the annular sleeve 17 and panel 6, particularly in those instances of large current demands through pin 26, a pair of insulating annular ceramic sleeves 28 are provided with each annular threaded sleeve 17 to surround pin 26. Each of the insulating sleeve pairs 28 is disposed in mirror-image relation on opposed faces of glass seal 27 and are so contoured that the lower extremity face of a smaller diameter portion 29 can be fused or epoxy glued to a face of seal 27 with the side wall faces of such smaller diameter portion substantially abutting the inner peripheral wall of externally threaded sleeve 17 with which it is associated and the inner peripheral wall substantially abutting the outer peripheral surface of the current conducting pin 26 disposed along the longitudinal central axis of threaded annular sleeve 17. A larger diameter annular shoulder 31 of each insulating sleeve 28 is arranged to overlap the outer face extremities of threaded annular sleeve 17.

Figure 4:
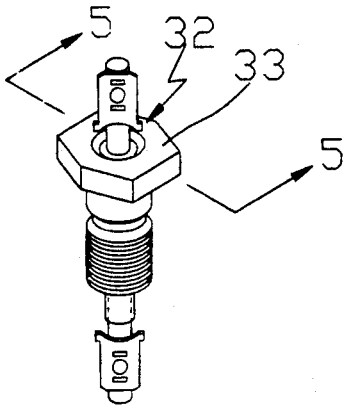
FIG. 4 is an isometric view of the novel self-contained smaller and lower current conducting pin assemblies, one of which is disclosed in FIG. 1 of the drawings.
Figure 5:
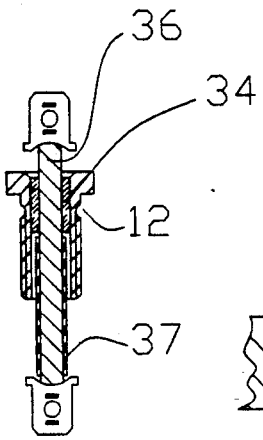
FIG. 5 is a cross-sectional view of the assembly of FIG. 4 taken in a plane through line 5—5 of FIG. 4; and, FIG. 6 is a cross-sectional view of a modified terminal pin assembly incorporating some features of the structure of FIGS. 1—3 with some features of the structure of FIG. 4 and 5.

Referring to FIG. 1 and to FIGS. 4 and 5 of the drawings, it can be seen that each of the smaller conducting pin assemblies 32 for the smaller openings 12 to conduct a lower rated current to a control unit disposed in wall machine housing 3 (not shown) can include a similar but smaller diameter externally threaded annular sleeve 33 adapted and sized to engage with the internal threads of a smaller opening 12. Each annular sleeve 33 is provided with a glass seal 34 extending between a current conducting pin 36 of smaller diameter than pin 26 since the rated current to be carried by such pin 36 is lower. In this embodiment, it is to be noted that insulating sleeves similar to annular insulating sleeves 28 are not used, but instead, an annular insulating sleeve or sock 37 snugly engages and protects the inner portion of smaller current conducting pin 36.

Figure 6:
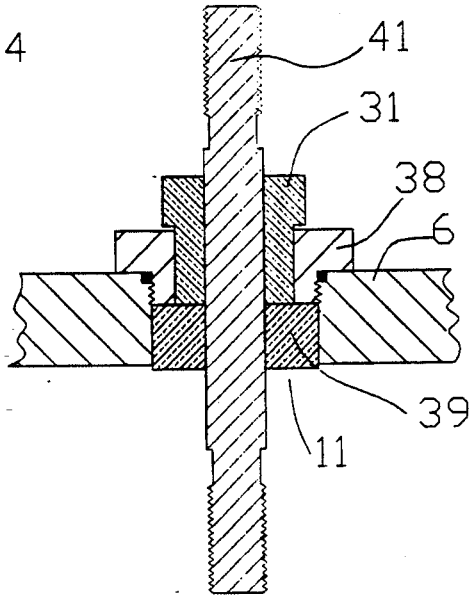

Referring to FIG. 6, which discloses a still further modification of the present invention, it can be seen that an externally threaded annular sleeve 38 can be provided to engage in internally threaded openings 11. Such externally threaded annular sleeve 38 can be longitudinally shorter than the distance from one face of panel 6 to the opposite face to allow for a glass seal 39 to extend between the outer peripheral surface of current conducting pin 41 and the internal peripheral surface of opening 11 with which the pin 41 is associated.

From the above, it can be seen that a novel hermetic assembly for carrying current of different ratings to a machine housing can be provided by the use of a single, readily mountable panel with openings sized and adapted to receive a plurality of self-contained current carrying pin arrangements, each appropriately configured for ready insertion and maintenance removal into such single panel.

The invention claimed is:

1. A hermetic assembly for a walled machine housing for a compressor unit and a control unit disposed in said machine housing comprising:

a machine housing with a wall housing panel opening in a wall of said machine housing;

a separate unitary panel removably mountable on the wall of said machine housing to sealingly cover said wall housing panel opening, said unitary panel having at least one pin assembly opening means and at least one current conducting pin assembly means extending therethrough;

internal thread means surroundingly extending along the inner peripheral surface of said pin assembly opening means;

said current conducting pin assembly means including an externally threaded annular flanged sleeve means adjustably engaging with said internal thread means of said pin assembly opening means, said externally threaded annular flanged sleeve means including an inner peripheral wall;

a single current conducting pin extending longitudinally through said inner peripheral wall of said externally threaded annular flanged sleeve means in spaced relation to said inner peripheral wall of said externally threaded annular flanged sleeve means;

a first fused sealing means cooperatively disposed between said single current conducting pin and said inner peripheral wall of said externally threaded annular flanged sleeve means; and a second sealing means including a compressible seal cooperatively disposed in a closeable recess configuration between the flange of said externally threaded flanged sleeve means and said pin assembly opening means to provide a tightly compressed seal therebetween when said externally threaded sleeve means is in full threaded engagement with said pin assembly opening means so that said first and second sealing means tightly seal said current conducting pin assembly means with said pin assembly opening means in said separate unitary panel.

2. The hermetic assembly of claim 1, said first fused sealing means comprising a glass seal.

3. The hermetic assembly of claim 1, said first fused sealing means comprising a glass seal abuttingly extending and fused between the outer peripheral surface of said single current conducting pin and said inner peripheral wall of said externally threaded annular flanged sleeve means.

4. The hermetic assembly of claim 1, further comprising an annular insulating second sleeve disposed between said single current conducting pin and said inner peripheral wall of said externally threaded annular flanged sleeve means to engage in sealing relation with said first fused sealing means.

5. The hermetic assembly of claim 1, said second compressible seal being in the form of a compressible rubber O-ring.

6. The hermetic assembly of claim 1, said externally threaded annular flanged sleeve means being of stainless steel.

7. The hermetic assembly of claim 1, said externally threaded annular flanged sleeve means being of an insulating ceramic material.

8. The hermetic assembly of claim 1, further comprising a third sealing means including an insulating annular second sleeve disposed between and in abutting contact with said single current conduction pin, and said internal peripheral wall of said externally threaded annular flanged sleeve means and said first fused sealing means to be in sealed contact therewith.

9. A hermetic assembly for a walled machine housing for a compressor unit and a control unit disposed in said housing comprising:

a machine housing with a wall housing panel opening in a wall of said machine housing;

a separate unitary wall panel removably mounted on the wall of said machine housing sized and configured to sealingly cover said wall housing panel opening, said unitary panel having a plurality of appropriately sized larger and smaller pin openings therein extending between opposed faces of said panel with each of said larger and smaller openings being provided with internal threads extending along the inner peripheral surface thereof from opposite faces of said panel;

a plurality of appropriately sized larger and smaller externally threaded annular stainless steel sleeve members for each of said larger and smaller openings respectively, each of said sleeve member being of a length substantially equivalent to the length of said opening and being adjustably engagable with said internal threads of one of said matchingly sized openings, each of said externally threaded annular sleeve including an annular shoulder configured with respect to said correspondingly matching opening to provide a closeable recess with a groove surrounding said corresponding opening along the outer face of said unitary wall panel;

a plurality of appropriately sized larger and smaller compressible rubber O-rings, each disposed in a correspondingly sized recess to seal the space therebetween;

a plurality of current conducting pins of larger and smaller diameter extending longitudinally along the central longitudinal axis of each of said larger and smaller externally threaded annular sleeve respectively, each being in spaced relation from the inner peripheral surface of the annular sleeve with which it is associated;

a plurality of glass seals, one for each of said externally threaded larger and smaller annular sleeve extending in fused relation between the outer peripheral surface of each said pins and the internal peripheral surface of said externally threaded annular sleeve with which it is associated;

a pair of insulating annular ceramic sleeves for each of said larger externally threaded sleeves, each pair of said insulating ceramic sleeves being disposed in mirror-image relation on opposed faces of said glass seal in fused embedded sealed relation therewith, with the outer peripheral surface of each insulating ceramic sleeve abutting the inner peripheral wall of the externally threaded sleeve with which it is associated and the inner peripheral wall of each insulating ceramic sleeve abutting the outer peripheral surface of the current conducting pin disposed along the longitudinal central axis of the associated externally threaded annular sleeve; and, a plurality of longitudinally extending plastic protective annular sleeve members each snugly engaging and protected the inner portion of said smaller current conducting pins.

* * * * *

UNITED STATES PATENT AND TRADEMARK OFFICE

CERTIFICATE OF CORRECTION

PATENT NO. : 5,227,587

DATED : July 13, 1993

INVENTOR(S) : F. Dieter Paterek

It is certified that error appears in the above-indentified patent and that said Letters Patent is hereby corrected as shown below:

Column 4, line 3, after "openings", ( first occurrence)
insert -- 11 --.

Signed and Sealed this

Sixth Day of September, 1994

Bruce Lehman

*Attest:*

BRUCE LEHMAN

*Attesting Officer*

*Commissioner of Patents and Trademarks*